US006274797B1

(12) United States Patent
Liao

(10) Patent No.: US 6,274,797 B1
(45) Date of Patent: Aug. 14, 2001

(54) COUPLING DEVICE FOR CLAMPING MORE CYMBALS

(76) Inventor: Tsun-Chi Liao, No. 14, Chun-Kung Rd., Pei-Tun Dist., Taichung City (TW)

( * ) Notice: Subject to any disclaimer, the term of this patent is extended or adjusted under 35 U.S.C. 154(b) by 0 days.

(21) Appl. No.: 09/686,938

(22) Filed: Oct. 12, 2000

(51) Int. Cl.[7] ..... G10D 13/02
(52) U.S. Cl. ..... 84/421; 84/327; 84/422.3
(58) Field of Search ..... 84/421, 327, 422.3

(56) References Cited

U.S. PATENT DOCUMENTS 4,365,535 * 12/1982 Buttner et al. ..... 84/421
4,987,817 * 1/1991 Diaz ..... 84/421
5,936,176 * 8/1999 Lombardi ..... 84/421
6,093,878 * 7/2000 Hoshino ..... 84/421

* cited by examiner

*Primary Examiner*—Shih-Yung Hsieh
(74) *Attorney, Agent, or Firm*—Bacon & Thomas, PLLC

(57) ABSTRACT

A coupling device comprises a multi-directional adjuster with one end clamped at a first center rod and the other at a connection kit; the adjuster further comprises a fixed and a movable clamping block disposed at each end of a main body, a cross slot and a clamping stud arranged at an outer end of the movable clamping block, and a head ferrule formed at the clamping stud. The connection kit further contains a coupling and a connecting sleeve; one end of the coupling is connected to the multi-directional adjuster via the clamping stud and one end of the connecting sleeve is extended to form a connecting rod whereto a limitation piece and two cotton washers are female-jointed externally for locking a cymbal and whereon two parallel faces are formed to be plugged in the sleeve of the coupling to facilitate tight locking of two locking bolts.

6 Claims, 5 Drawing Sheets

COUPLING DEVICE FOR CLAMPING MORE CYMBALS

BACKGROUND OF THE INVENTION

This invention relates generally to cymbal stands, more particularly, it relates to a coupling device that permits a cymbal stand to clamp more angle-adjustable cymbals.

A conventional cymbal stand shown in FIG. 1 usually has an adjustable clamping seat at its center rod for holding and adjusting a cymbal.

However, a mono-tuned single cymbal is somewhat inadequate in a band for expressing different timbres, hence, a drummer is always found busy in locating a plurality of cymbals hung on cymbal stands disorderly surrounding drums to make his performance a complicated sweat.

SUMMARY OF THE INVENTION

The primary object of this invention is to provide a coupling device that allows a cymbal stand to accept more angle-adjustable cymbals.

Another object of this invention is to provide a coupling device that can fit in with a generic cymbal stand for replacement and for multi-directional adjustment.

For realizing abovesaid objects, the coupling device of this invention mainly comprises a multi-directional adjuster with one end clamped at a first center rod and the other at a connection kit, wherein the adjuster further comprises a fixed and a movable clamping block disposed at each end of a main body; a cross slot and a clamping stud arranged at an outer end of the movable clamping block; and a head ferrule formed at the clamping stud. The connection kit further contains a coupling at one end and a connecting sleeve at the other, wherein one end of the coupling is a sleeve fixed with two opposite bolts, and the coupling is connected to the multi-directional adjuster via the clamping stud; a thread portion is formed at one end inside the connecting sleeve which is locked with two locking bolts while the other end of the connecting sleeve is extended to form a connecting rod whereto a limitation piece and two cotton washers are female-jointed externally for locking a cymbal and whereon two parallel faces are formed to be plugged in the sleeve of the coupling to facilitate tight locking of two locking bolts.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
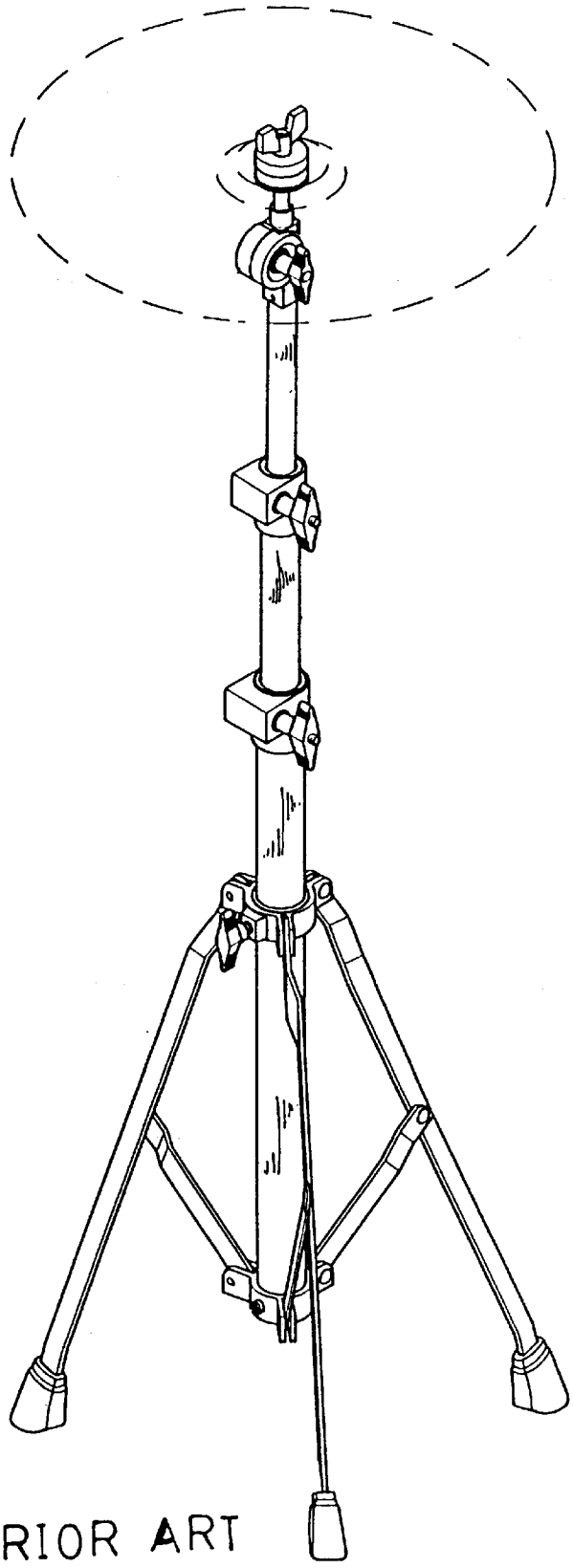
PRIOR ART Fig.1
FIG. 1 is an elevational view of a conventional cymbal stand.
Figure 2:
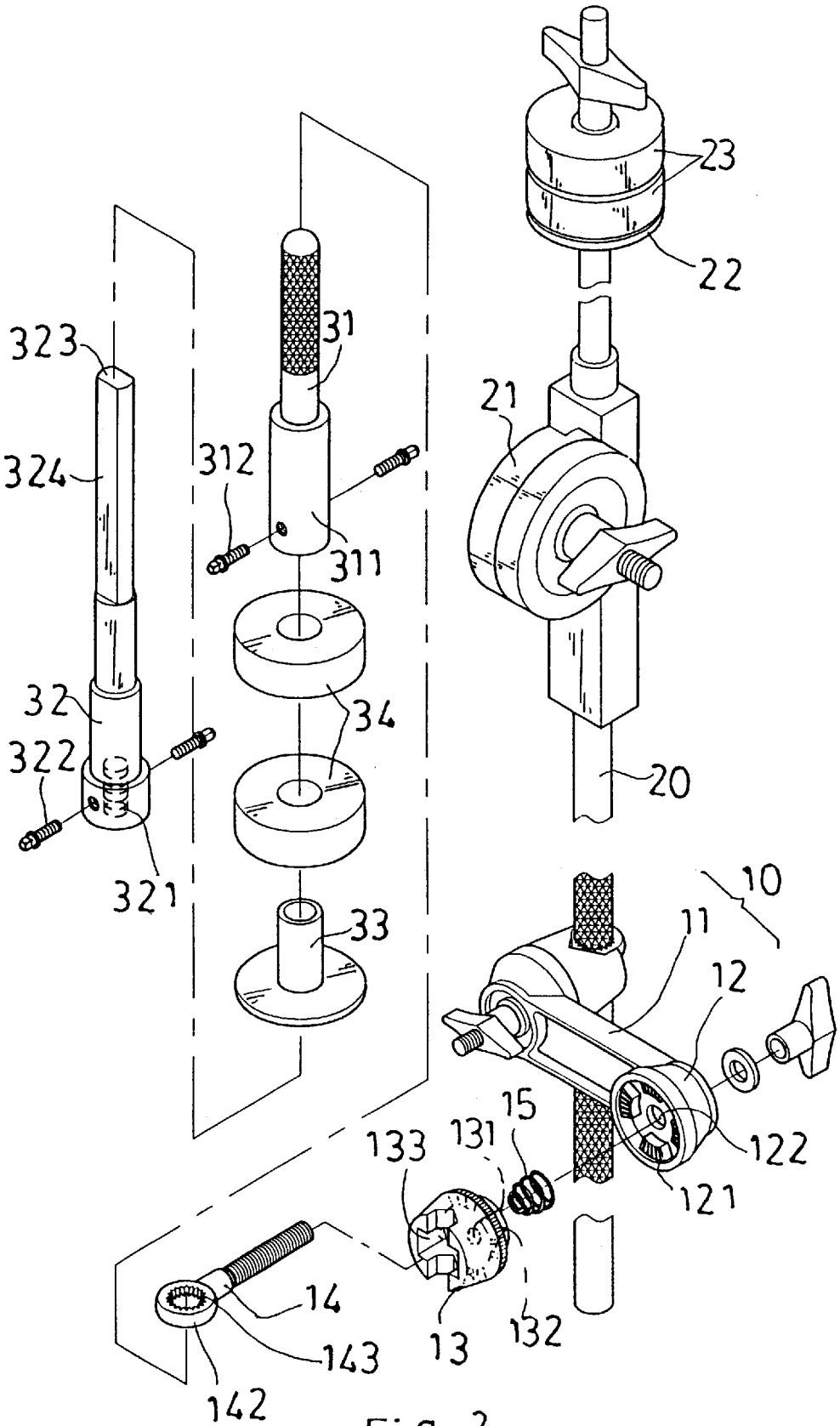
FIG. 2 is an exploded view of this invention in three dimensions.

As illustrated in FIGS. 2 through 5, a coupling device of this invention mainly comprises a multi-directional adjuster 10 having one end clamped on a first center rod 20 and the other end on a connection kit 30.

The adjuster 10 further comprises:

a main body 11 having its two ends provided with a fixed clamping block 12 individually, wherein an annularly spaced and segmented tooth alignment 121 is formed in an inner ring of the clamping block 12 while a through hole 122 is positioned in center of the clamping block 12;

a pair of movable clamping blocks 13 fixedly jointed with the fixed clamping blocks 12 respectively, wherein a through hole 131 is centered in the movable clamping block 13; an annular tooth alignment 132 is arranged peripherally around the through hole 131 so as to engage with the tooth alignment 121 of the fixed clamping block 12; and a cross-slot 133 is formed at the other end of each the movable clamping block 13 opposite to the through hole 131;

a pair of clamping studs 14 penetrating through the fixed clamping block 12 and the through hole 131 respectively, wherein a wing nut 141 is used to lock the fixed and the movable clamping block 12, 13 together, and each the clamping stud 14 has a head ferrule 142 provided with an annular tooth alignment 143; and a pair of compressible springs 15 disposed between the fixed and the movable clamping block 12, 13 respectively.

The connection kit 30 further comprises:

a coupling 31 having a sleeve 311 at one end, wherein a pair of locking bolts 312 are positioned oppositely in circumferential face of the sleeve 311; the coupling 31 is fixedly clamped at the multi-directional adjuster 10 by taking advantage of the clamping stud 14; and the other end of the coupling 31 bears an obscure pattern; and a connecting sleeve 32 having a thread portion 321 at one end and a pair of locking bolts 322 positioned oppositely, wherein the other end of the connecting sleeve 32 is extended to form a connecting rod 323 to be sleeve-jointed with a limitation piece 33 as well as two cotton washers 34 for locking a cymbal 4; two parallel faces 324 are formed on the connecting rod 323 to facilitate propping the locking bolts 312 of the sleeve 311 tightly against the connecting rod 323.

The first center rod 20 is provided with an adjustment clamping seat 21, a limitation piece 22, and two cotton washers 23 for locking the cymbal 4.

Figure 3:
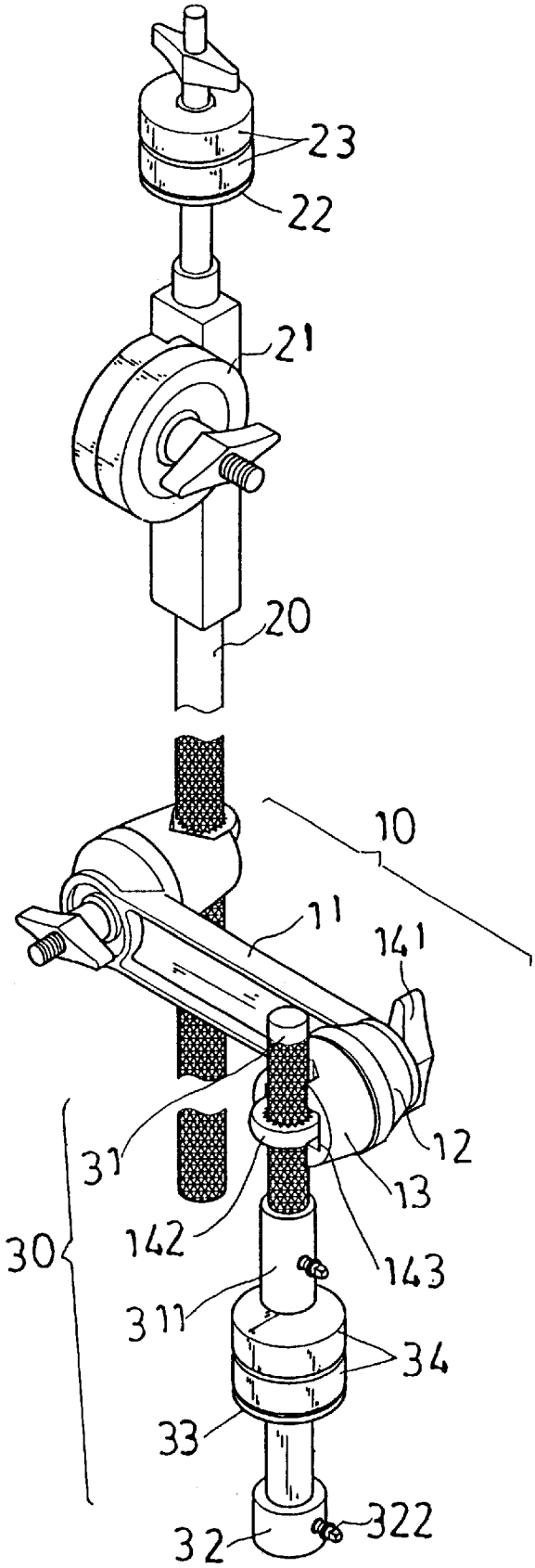
FIG. 3 is a perspective elevational view of this invention.
Figure 4:
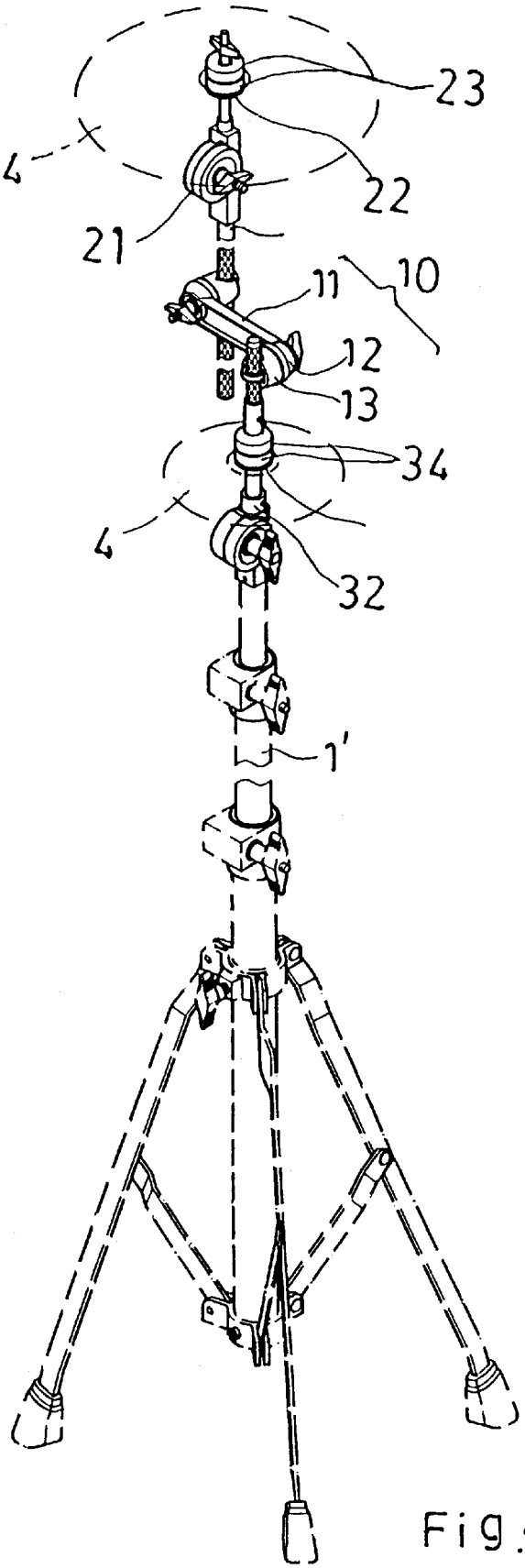
FIG. 4 is a schematic view of a first embodiment of this invention.
Figure 5:
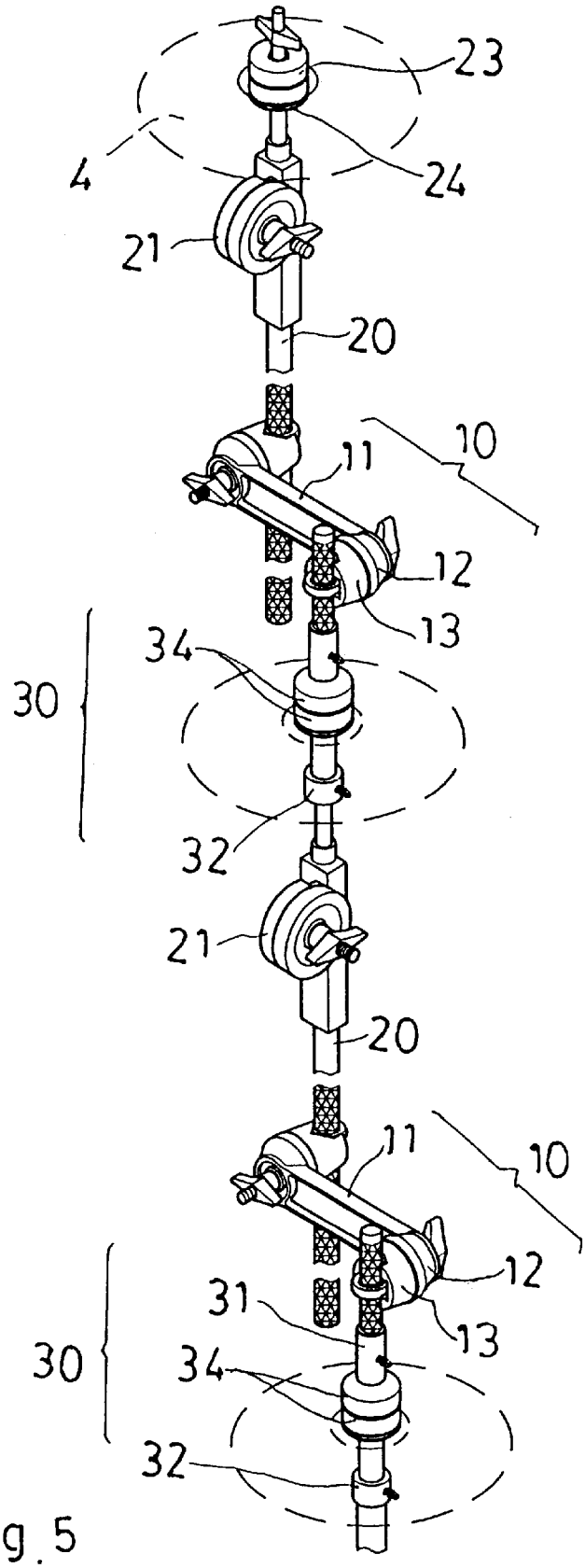
FIG. 5 is a schematic view of a second embodiment of this invention.

When assembling, as shown in FIGS. 3 and 4, the coupling 31 is inserted in the head ferrule 142 of the clamping stud 14, clenched by the cross slot 133, and fixedly jointed to the adjuster 10. The connection kit 30 may be adjusted multi-directionally to have the cymbal 4 in different timbres clamped between the cotton washers 34, 23 of the connection kit 30 and the first center rod 20 respectively. If change of a conventional cymbal stand hung with a cymbal 4 shown in FIG. 1 into a cymbal stand 1' hung with two cymbals 4 shown in FIG. 4, a user is supposed to remove the original cymbal 4 firstly, then collar the connecting sleeve 32 onto a center rod of the cymbal stand 1' and lock it with the locking bolts 322. As more than one cymbal 4 with different timbres can be clamped at the cymbal stand 1' between those two cotton washers 34, 23 of the connection kit 30 and the first center rod 20 respectively and can be adjusted in angle or orientation with respect to the first center rod 20 so that a drummer may have the cymbals set ready in order for performance.

Moreover, in addition to load the coupling device of this invention on the cymbal stand 1' without needing to purchase a brand new cymbal stand for laying two cymbals 4, one more set of the coupling device may be added to this invention so as to form a cymbal stand that can accept three cymbals 4.

In the above described, at least one preferred embodiment has been elucidated with reference to drawings annexed, it is apparent that numerous variations or modifications may be made without departing from the true spirit and scope thereof, as set forth in the claims below.

What is claimed is:

1. A coupling device for clamping more cymbals, wherein extra cymbals can be added to a center rod of cymbal stand if desired, comprising a multi-directional adjuster having one end clamped at a first center rod and the other at a connection kit, wherein the multi-directional adjuster further comprises:

a main body having a fixed clamping block disposed at its both ends individually; an annular tooth alignment and a through hole are arranged in an inner ring and in center of the fixed clamping block respectively;

a pair of movable clamping blocks fixedly jointed with the fixed clamping blocks respectively; a through hole is centered in the movable clamping block; an annular tooth alignment is arranged peripherally around the through hole so as to engage with the tooth alignment of the fixed clamping block; and a cross-slot is formed at another end of each the movable clamping block opposite to the through hole; and a pair of clamping studs penetrating through the through hole of both the fixed clamping block and the moveable clamping block respectively; a wing nut is used to lock the fixed and the movable clamping block together, and each the clamping stud has a head ferrule;

the connection kit further comprising:

a coupling having a sleeve at one end; a pair of locking bolts are positioned oppositely in surface of the sleeve for locking a connecting sleeve; and the coupling is fixedly clamped at the multi-directional adjuster by taking advantage of the clamping stud; and the connecting sleeve having a thread portion at one end and a pair of locking bolts positioned oppositely, and another end of the connecting sleeve is extended to form a connecting rod to be sleeve-jointed with a limitation piece as well as two cotton washers for locking a cymbal; and two parallel faces are formed on the connecting rod to facilitate propping the locking bolts of the sleeve tightly against the connecting rod.

2. The coupling device according to claim 1, wherein an annular tooth alignment is formed in an inner ring of the head ferrule for engaging with the center rod or the coupling.

3. The coupling device according to claim 1, wherein surface of one end of the coupling bears an obscure pattern.

4. The coupling device according to claim 1, wherein the annular tooth alignment in the inner ring of the fixed clamping block is equally spaced and segmented.

5. The coupling device according to claim 1, wherein a compressible spring is inserted between the fixed and the movable clamping block.

6. The coupling device according to claim 1, wherein an adjustable clamping seat, a limitation piece, and two cotton washers are provided to the first center rod for locking a cymbal.

* * * * *